US012546304B2

(12) United States Patent
Schmidt et al.

(10) Patent No.: US 12,546,304 B2
(45) Date of Patent: Feb. 10, 2026

(54) METHODS OF INCREASING EFFICIENCY OF PLUNGER LIFT OPERATIONS

(71) Applicant: ExxonMobil Technology and Engineering Company, Spring, TX (US)

(72) Inventors: David J. Schmidt, Morristown, NJ (US); Krishnan Kumaran, Raritan, NJ (US); Donald Allen Burnett, Spring, TX (US); Patrick E. Goschy, Katy, TX (US); Brian C. Seabrook, Houston, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 527 days.

(21) Appl. No.: 17/652,934

(22) Filed: Mar. 1, 2022

(65) Prior Publication Data

US 2022/0372852 A1 Nov. 24, 2022

Related U.S. Application Data

(60) Provisional application No. 63/192,280, filed on May 24, 2021.

(51) Int. Cl.

| | |
|---|---|
| ***E21B 43/12*** | (2006.01) |
| ***E21B 47/00*** | (2012.01) |
| ***E21B 47/008*** | (2012.01) |
| ***F04B 47/12*** | (2006.01) |
| ***F04B 49/20*** | (2006.01) |
| ***F04B 51/00*** | (2006.01) |

(52) U.S. Cl.

CPC ..... *F04B 47/12* (2013.01); *E21B 43/121* (2013.01); *E21B 47/00* (2013.01); *E21B 47/008* (2020.05); *F04B 49/20* (2013.01); *F04B 51/00* (2013.01); *F04B 2201/0202* (2013.01)

(58) Field of Classification Search

CPC ..... F04B 47/12; F04B 49/20; F04B 51/00; F04B 2201/0202; E21B 47/008

See application file for complete search history.

(56) References Cited

U.S. PATENT DOCUMENTS

| | | | | |
|---|---|---|---|---|
| 10,089,994 | B1 * | 10/2018 | Radzishevsky | G10L 21/038 |
| 2004/0216886 | A1 * | 11/2004 | Rogers, Jr. | E21B 43/121 166/372 |
| 2011/0247831 | A1 * | 10/2011 | Smith | F04B 47/10 166/372 |
| 2013/0259211 | A1 * | 10/2013 | Vlack | G06F 16/284 379/88.01 |

(Continued)

*Primary Examiner* — Connor J Tremarche

(74) *Attorney, Agent, or Firm* — ExxonMobil Technology and Engineering Company—Law Department

(57) ABSTRACT

Methods of increasing efficiency of plunger lift operations and hydrocarbon wells that perform the methods are disclosed herein. The methods include monitoring an acoustic output from the hydrocarbon well. The methods also include calculating a plunger speed of a plunger of the hydrocarbon well as the plunger travels toward a surface region and calculating a discharge duration of a liquid discharge time period during which liquid is discharged from the hydrocarbon well. The methods further include correlating the plunger speed and the discharge duration to a discharge volume of liquid discharged from the hydrocarbon well.

26 Claims, 9 Drawing Sheets

(56) References Cited

U.S. PATENT DOCUMENTS

| | | | | |
|---|---|---|---|---|
| 2014/0305636 | A1* | 10/2014 | Paulet | E21B 43/082 166/372 |
| 2015/0134258 | A1* | 5/2015 | Luppens | E21B 49/003 702/11 |
| 2015/0302086 | A1* | 10/2015 | Roberts | G06F 16/683 707/771 |
| 2016/0125889 | A1* | 5/2016 | Westerman | G10L 25/51 704/270 |
| 2016/0247405 | A1* | 8/2016 | Paczan | G08G 5/0069 |
| 2018/0058191 | A1* | 3/2018 | Romer | E21B 49/08 |
| 2018/0119692 | A1* | 5/2018 | Bangor | E21B 47/107 |
| 2022/0145873 | A1* | 5/2022 | Dellutri | G01F 1/64 |

* cited by examiner

METHODS OF INCREASING EFFICIENCY OF PLUNGER LIFT OPERATIONS

CROSS REFERENCE TO RELATED APPLICATIONS

This application claims the benefit of U.S. Provisional Application No. 63/192,280, filed May 24, 2021, and is herein incorporated by reference in its entirety.

FIELD OF THE INVENTION

The present disclosure relates generally to methods of increasing efficiency of plunger lift operations and/or to hydrocarbon wells that perform the methods.

BACKGROUND OF THE INVENTION

Plunger lift operations are cyclical operations that utilize a plunger, in combination with gas assist, to produce liquids from hydrocarbon wells. More specifically, the plunger lift operations accumulate liquids above the plunger while the plunger is positioned within a downhole region of the hydrocarbon well and subsequently utilize gas pressure below the plunger to convey the plunger, together with the liquids, to the surface. The plunger then returns to the downhole region of the hydrocarbon well and the cycle is repeated. In some examples, the gas pressure is provided by naturally occurring gasses that are produced by the hydrocarbon well. In some examples, gas is injected to generate at least a portion of the gas pressure.

Regardless of the exact configuration, a production valve generally is the primary mechanism utilized to control gas lift operations. More specifically, the production valve is opened to decrease pressure above the plunger and initiate motion of the plunger toward the surface. Once the liquid and gas have been produced, the production valve is closed to return the plunger to the downhole region of the hydrocarbon well. The relative timing of the open and closed states of the production valve controls the plunger lift operation.

Plunger lift operations are mechanically simple and generally function even if they are not performed in an optimal manner. As an example, plunger lift operations generally function even when a volume of liquid conveyed to the surface is outside a desired volume range. Traditionally, optimization of plunger lift operations has been performed by providing the produced liquid from one or more wells to a storage tank, measuring the volume of liquid produced for a given timeframe, and then adjusting the relative timing of open and closed states of the production valve based upon the measured volume of produced liquid. While effective in certain circumstances, such optimization methodologies may be cumbersome, may be labor-intensive to implement, and/or only may provide information regarding average liquid production over the given timeframe. Thus, there exists a need for improved methods of increasing efficiency of plunger lift operations and/or for hydrocarbon wells that perform the methods.

SUMMARY OF THE INVENTION

Methods of increasing efficiency of plunger lift operations and hydrocarbon wells that perform the methods are disclosed herein. The methods include monitoring, with an acoustic monitoring system and during a production time period, an acoustic output from the hydrocarbon well as a function of time. The production time period includes an uphole travel time period during which a plunger of the hydrocarbon well travels toward a surface region, a liquid discharge time period during which liquid, which is above the plunger during the uphole travel time period, is discharged from the hydrocarbon well, and a gas discharge time period, during which gas, which is below the plunger during the uphole travel time period, is discharged from the hydrocarbon well. The methods also include calculating a plunger speed of the plunger during the uphole travel time period. The plunger speed is calculated based, at least in part, on the acoustic output during the uphole travel time period. The methods further include calculating a discharge duration of the liquid discharge time period. The methods also include correlating the plunger speed during the uphole travel time period and the discharge duration to a discharge volume of water discharged from the hydrocarbon well during the liquid discharge time period.

DETAILED DESCRIPTION OF THE INVENTION

Figure 1:
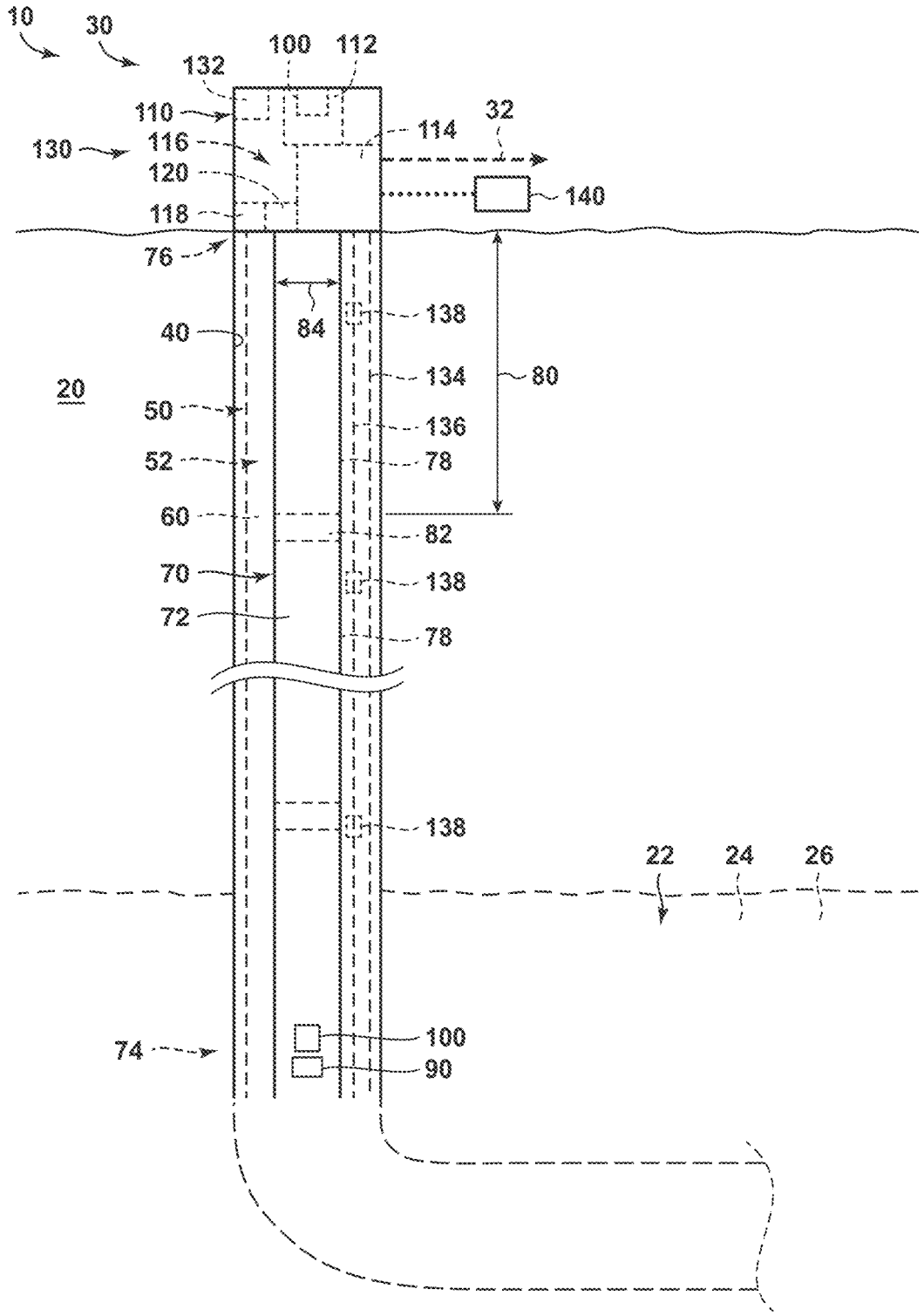
FIG. 1 is a schematic illustration of examples of hydrocarbon wells that may be utilized with and/or may perform methods, according to the present disclosure.

FIGS. 1-15 provide examples of hydrocarbon wells 30, of methods 300, of acoustic output, and/or of analysis of the acoustic output, according to the present disclosure. Elements that serve a similar, or at least substantially similar, purpose are labeled with like numbers in each of FIGS. 1-15, and these elements may not be discussed in detail herein with reference to each of FIGS. 1-15. Similarly, all elements may not be labeled in each of FIGS. 1-15, but reference numerals associated therewith may be utilized herein for consistency. Elements, components, and/or features that are discussed herein with reference to one or more of FIGS. 1-15 may be included in and/or utilized with any of FIGS. 1-15 without departing from the scope of the present disclosure.

In general, elements that are likely to be included in a particular embodiment are illustrated in solid lines, while elements that are optional are illustrated in dashed lines. However, elements that are shown in solid lines may not be essential to all embodiments and, in some embodiments, may be omitted without departing from the scope of the present disclosure.

FIG. 1 is a schematic illustration of examples of hydrocarbon wells 30 that may be utilized with and/or may perform methods 300, according to the present disclosure. As illustrated in solid lines in FIG. 1, hydrocarbon wells 30 include a wellbore 40 that extends within a subsurface region 20. Wellbore 40 also may be referred to herein as extending between a surface region 10 and subsurface region 20. Subsurface region 20 may include a subterranean formation 22, which may include liquids 24 and/or gasses 26. Wellbore 40 may extend within the subterranean formation and may produce, or may be utilized to produce, a produced fluid stream 32, which may include liquids 24 and/or gasses 26. Examples of hydrocarbon well 30 include a natural gas well and/or an oil well.

As also illustrated in solid lines in FIG. 1, hydrocarbon wells 30 include production tubing 70, which extends within wellbore 40 and/or defines a tubing conduit 72. In some examples, and as illustrated in dashed lines in FIG. 1, production tubing 70 may include and/or may be formed and/or defined by a plurality of tubing segments 78, which may be joined by a corresponding plurality of tubing joints 82 and/or may have and/or define a corresponding segment length 80. Production tubing 70 may have and/or define a tubing inner diameter 84, which also may be referred to herein as a conduit outer diameter 84. In some examples, hydrocarbon wells 30 also may include a casing string 50. Casing string 50, when present, may extend within wellbore 40 and/or may define a casing conduit 52. In some such examples, production tubing 70 may extend within casing conduit 52, and/or casing string 50 and production tubing 70 may define an annular space 60 therebetween.

Hydrocarbon wells 30 also include a plunger seat 90, which may be positioned within a downhole region 74 of tubing conduit 72. Hydrocarbon wells 30 further include a plunger 100. As illustrated in solid lines in FIG. 1 and discussed in more detail herein, plunger seat 90 may be adapted, configured, designed, sized, and/or constructed to receive, to at least temporarily support, to retain, and/or to cushion a downhole motion of plunger 100.

Hydrocarbon wells 30 further include a surface tree 110. Surface tree 110 may be in fluid communication, or in selective fluid communication, with an uphole end region 76 of tubing conduit 72. Surface tree 110 may include a catcher 112, which may be configured to receive, to retain, and/or to selectively retain plunger 100, as illustrated in dashed lines in FIG. 1. This may include retaining the plunger when the plunger travels from downhole region 74 to surface region 10, which is discussed in more detail herein. Surface tree 110 also may include a production valve 114, which may be configured to control, to selectively control, to regulate, and/or to selectively regulate production of produced fluid stream 32 from the hydrocarbon well.

Hydrocarbon wells 30 also include an acoustic monitoring system 130. Acoustic monitoring system 130 may be adapted, configured, designed, and/or constructed to monitor an acoustic output from, sounds produced from, noises produced by, and/or vibrations produced by hydrocarbon wells 30. Stated another way, the acoustic output may include and/or may be defined by a plurality of sounds, noises, and/or vibrations produced by the hydrocarbon wells, and the acoustic monitoring system may be configured to monitor, to detect, to quantify, and/or to record the plurality of sounds. As examples, this may include monitoring the acoustic output as a function of time and/or during a production time period of the hydrocarbon well. Stated another way, acoustic monitoring system 130 may be configured to detect the acoustic output from hydrocarbon wells 30 at least while the hydrocarbon wells produce produced fluid stream 32.

In some examples, acoustic monitoring system 130 includes a surface acoustic sensor 132, which may be configured to detect and/or to monitor the acoustic output. Examples of the surface acoustic sensor include a surface microphone and/or a surface vibration sensor. In some examples, the acoustic monitoring system includes a downhole acoustic sensor 134, which may be positioned along a length of wellbore 40. An example of the downhole acoustic sensor includes a distributed acoustic sensor 136, such as a fiber optic cable, which may extend along at least a fraction of the length of the wellbore. Another example of the downhole acoustic sensor includes at least one discrete downhole acoustic sensor 138, or even a plurality of discrete downhole acoustic sensors 138. Examples of the discrete downhole acoustic sensor include a downhole microphone and/or a downhole vibration sensor.

Hydrocarbon wells 30 further include a controller 140. Controller 140 may be adapted, configured, designed, constructed, and/or programmed to control the operation of hydrocarbon wells 30 and/or of at least one other component of hydrocarbon wells 30. This may include controlling the operation of, receiving one or more signals from, and/or providing one or more signals to acoustic monitoring system 130 and/or production valve 114. As a specific example, controller 140 may be programmed to selectively transition production valve 114 between an open state, in which the hydrocarbon well produces, or is configured to produce, produced fluid stream 32, and a closed state, in which the hydrocarbon well does not produce, or is not configured to produce, the produced fluid stream. In some examples, the production time period of the hydrocarbon well may include periods of time in which the production valve is in the open state, while a shut-in time period of the hydrocarbon well may include periods of time in which the production valve is in the closed state. Additionally or alternatively, controller 140 may be programmed to control the operation of hydrocarbon wells 30 according to, utilizing, and/or by performing any suitable step and/or steps of methods 300, which are discussed in more detail herein.

Controller 140 may include and/or be any suitable structure, device, and/or devices that may be adapted, configured, designed, constructed, and/or programmed to perform the functions discussed herein. This may include controlling the operation of the at least one other component of hydrocarbon wells 30, such as via performing one or more steps of methods 300. As examples, controller 140 may include one or more of an electronic controller, a dedicated controller, a special-purpose controller, a personal computer, a special-purpose computer, a display device, a touch screen display, a logic device, a memory device, and/or a memory device having computer-readable storage media.

The computer-readable storage media, when present, also may be referred to herein as non-transitory computer-readable storage media. This non-transitory computer-readable storage media may include, define, house, and/or store computer-executable instructions, programs, and/or code; and these computer-executable instructions may direct hydrocarbon wells 30 and/or controller 140 thereof to perform any suitable portion, or subset, of methods 300. Examples of such non-transitory computer-readable storage media include CD-ROMs, disks, hard drives, flash memory, etc. As used herein, storage, or memory, devices and/or media having computer-executable instructions, as well as computer-implemented methods and other methods according to the present disclosure, are considered to be within the scope of subject matter deemed patentable in accordance with Section 101 of Title 35 of the United States Code.

Hydrocarbon wells 30 and/or surface tree 110 may include a property sensor 116. Property sensor 116, when present, may be adapted, configured, designed, and/or constructed to monitor at least one property of the hydrocarbon well. The at least one property of the hydrocarbon well may differ from, or be in addition to, the acoustic output that is monitored by acoustic monitoring system 130. In some examples, property sensor 116 may include and/or be an annulus property sensor 118, which may be in fluid communication with annular space 60 and/or may be configured to provide an annulus property measurement signal, which is indicative of a property within the annular space, to controller 140. In some examples, property sensor 116 may include and/or be a production tubing property sensor 120, which may be in fluid communication with tubing conduit 72 and/or may be configured to provide a tubing conduit property signal, which is indicative of a property within the tubing conduit, to the controller. Examples of the at least one property of the hydrocarbon well include a temperature of produced fluid stream 32, a pressure of the produced fluid stream, a differential pressure between the produced fluid stream and the annular space, a flow rate of the produced fluid stream, a flow rate of the gas discharged from the hydrocarbon well within the produced fluid stream, and/or a flow rate of the liquid discharged from the hydrocarbon well within the produced fluid stream.

FIGS. 2-7 are schematic illustrations of portions of plunger lift operations that may be performed by hydrocarbon wells 30 and/or during methods 300, according to the present disclosure. FIGS. 2-7 may be less schematic and/or more detailed illustrations of hydrocarbon wells 30 of FIG. 1 and/or may illustrate various configurations for hydrocarbon wells 30 of FIG. 1. With this in mind, any of the structures, functions, and/or features, which are disclosed herein with reference to hydrocarbon wells 30 of FIGS. 2-7, may be included in and/or utilized with hydrocarbon wells 30 of FIG. 1 without departing from the scope of the present disclosure. Similarly, any of the structures, functions, and/or features that are disclosed herein with reference to hydrocarbon wells 30 of FIG. 1 may be included in and/or utilized with hydrocarbon wells 30 of FIGS. 2-7 without departing from the scope of the present disclosure.

Figure 2:
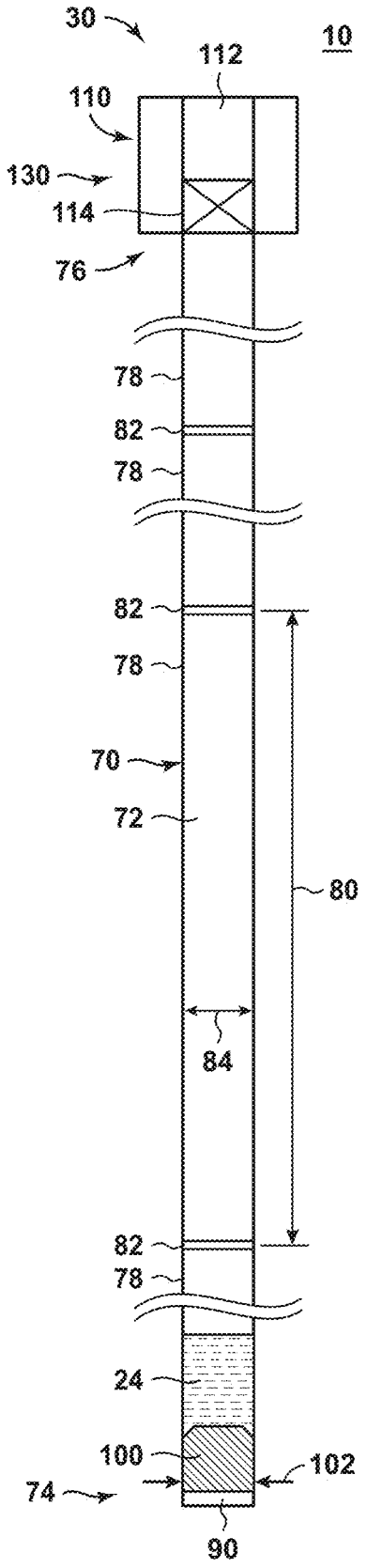
FIG. 2 is a schematic illustration of a portion of a plunger lift operation, according to the present disclosure.

During operation of hydrocarbon wells 30, or during a plunger lift operation of the hydrocarbon wells, and during the shut-in time period of the hydrocarbon well, plunger 100 may be positioned within downhole region 74 of the hydrocarbon well and/or may rest on plunger seat 90 of the hydrocarbon well. Also during the shut-in time period of the hydrocarbon well, liquids 24 may accumulate within tubing conduit 72 and above, or vertically above, plunger 100, which may have and/or define a plunger outer diameter 102. This is illustrated in FIG. 2.

Figure 3:
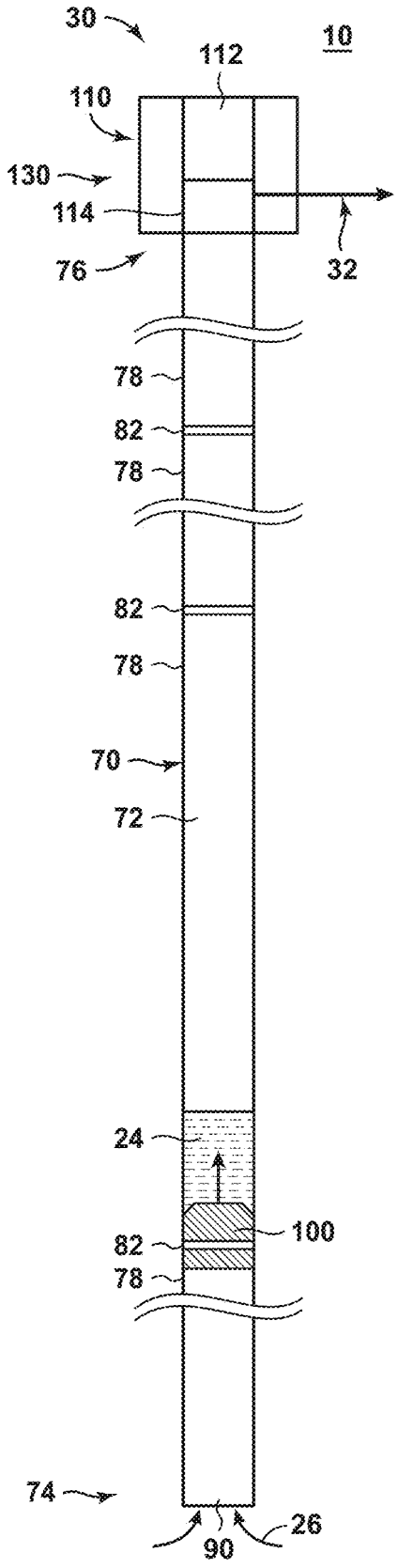
FIG. 3 is a schematic illustration of a portion of a plunger lift operation, according to the present disclosure.

Subsequently, production valve 114 of the hydrocarbon well may be opened, which may begin and/or initiate the production time period for the hydrocarbon well. As illustrated in FIG. 3, initiation of the production time period, via opening the production valve, may cause a pressure within uphole end region 76 of tubing conduit 72 to decrease. This may permit gasses 26 to flow into the tubing conduit, to expand, and/or to convey plunger 100 away from downhole region 74 and/or toward uphole end region 76. This is illustrated by the transition from the configuration illustrated in FIG. 2 to the configuration illustrated in FIG. 3 and also by the upward-facing arrow associated with plunger 100 in FIG. 3. Motion of plunger 100 toward uphole end region 76 of tubing conduit 72 and/or toward surface region 10 may occur, or may be referred to herein as occurring, during an uphole travel time period of the production time period.

During motion of the plunger within the tubing conduit, the plunger may pass, may be conveyed past, and/or may move through tubing segments 78 and/or tubing joints 82 of production tubing 70. This motion of the plunger past and/or through the tubing segments and/or the tubing joints may produce and/or generate acoustic output in the form of distinctive and/or corresponding sounds, which may be referred to herein as uphole travel sounds. An example of the uphole travel sounds includes joint crossing sounds, which may be generated as the plunger travels past each tubing joint 82 and toward uphole end region 76. As discussed in more detail herein with reference to methods 300 of FIG. 8, the acoustic output during the production time period, such as the uphole travel sounds and/or the joint crossing sounds, may be detected by acoustic monitoring system 130, may be utilized to calculate, estimate, and/or quantify a plunger speed of the plunger during the uphole travel time period, and/or may be utilized to increase efficiency of the plunger lift operation.

Figure 4:
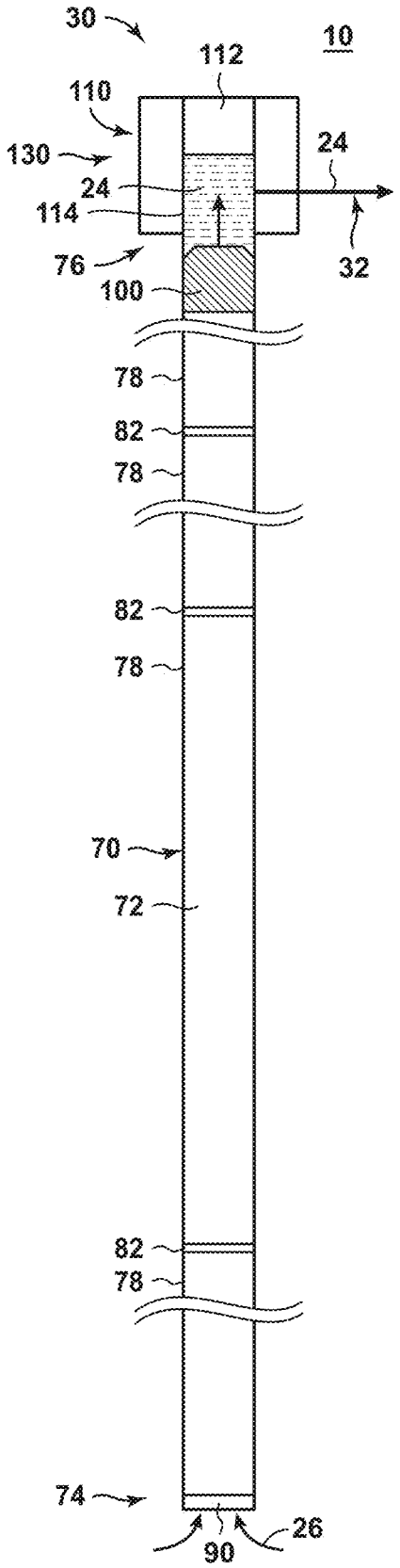
FIG. 4 is a schematic illustration of a portion of a plunger lift operation, according to the present disclosure.

As illustrated in FIG. 4, plunger 100 may travel to and/or into uphole end region 76, thereby urging liquids 24 from tubing conduit 72 in, within, and/or as produced fluid stream 32. Flow of the liquids from the tubing conduit, through the production valve, and/or as the produced fluid stream may occur, or may be referred to herein as occurring, during a liquid discharge time period of the production time period. The production of the liquids may produce and/or generate acoustic output in the form of distinctive and/or corresponding sounds, which may be referred to herein as liquid discharge sounds. As discussed in more detail herein with reference to methods 300 of FIG. 8, the acoustic output during the liquid discharge time period, such as the liquid discharge sounds, may be detected by acoustic monitoring system 130, may be utilized to calculate, estimate, and/or quantify a duration of the liquid discharge time period, and/or may be utilized to increase efficiency of the plunger lift operation.

Figure 5:
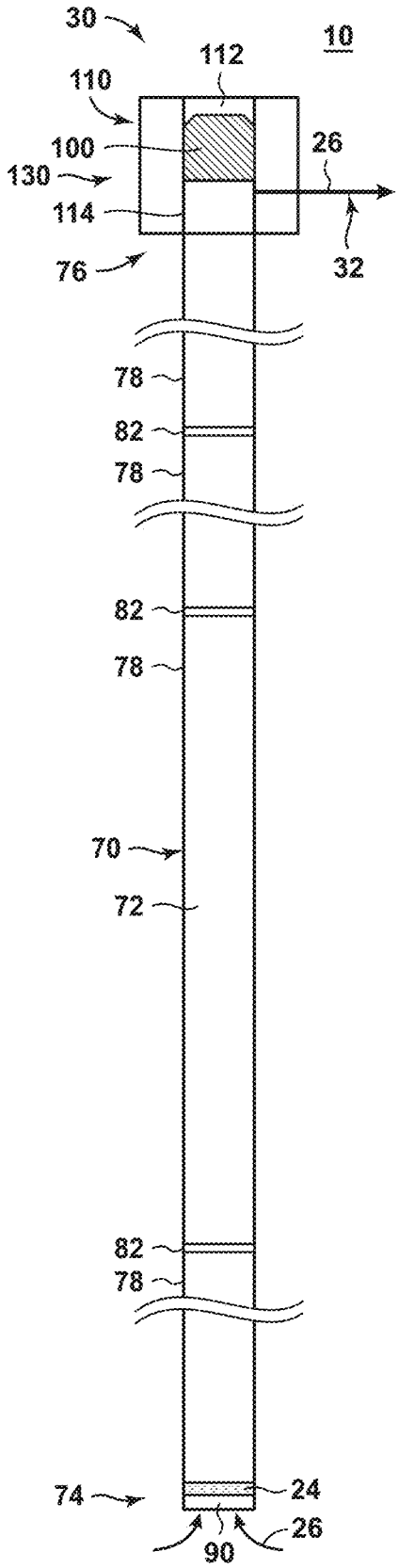
FIG. 5 is a schematic illustration of a portion of a plunger lift operation, according to the present disclosure.

As illustrated in FIG. 5, plunger 100 then may be retained, or caught, by catcher 112; and gasses 26 may flow from tubing conduit 72 in, within, and/or as produced fluid stream 32. Flow of the gasses from the tubing conduit, through the production valve, and/or as the produced fluid stream may occur, or may be referred to herein as occurring, during a gas discharge time period of the production time period. The production of gasses may produce and/or generate acoustic output in the form of distinctive and/or corresponding sounds, which may be referred to herein as gas discharge sounds. As discussed in more detail herein with reference to methods 300 of FIG. 8, the acoustic output during the gas discharge time period, such as the gas discharge sounds, may be detected by acoustic monitoring system 130, may be utilized to calculate, estimate, and/or quantify the duration of the liquid discharge time period, may be utilized to calculate, estimate, and/or quantify a duration of the gas discharge time period, and/or may be utilized to increase efficiency of the plunger lift operation.

Figure 6:
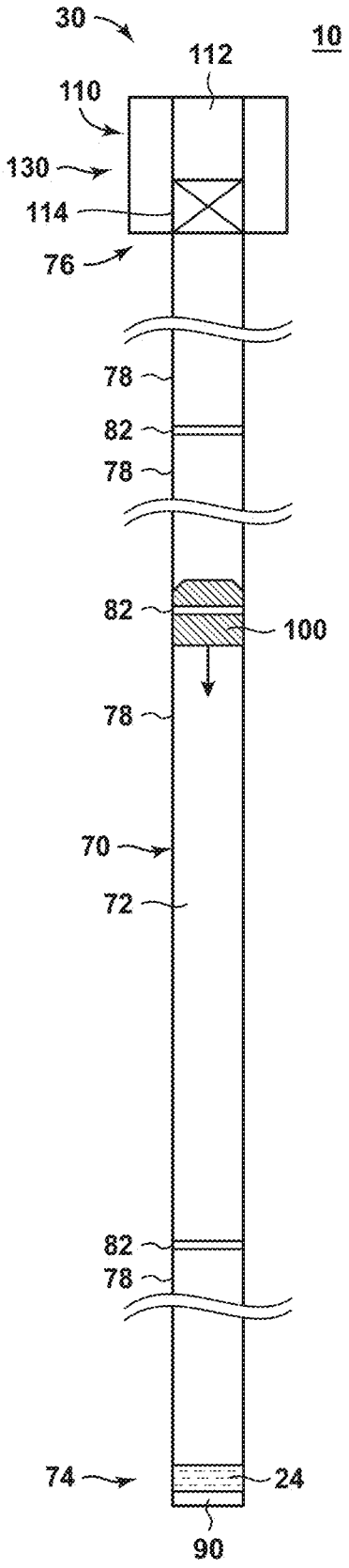
FIG. 6 is a schematic illustration of a portion of a plunger lift operation, according to the present disclosure.
Figure 7:
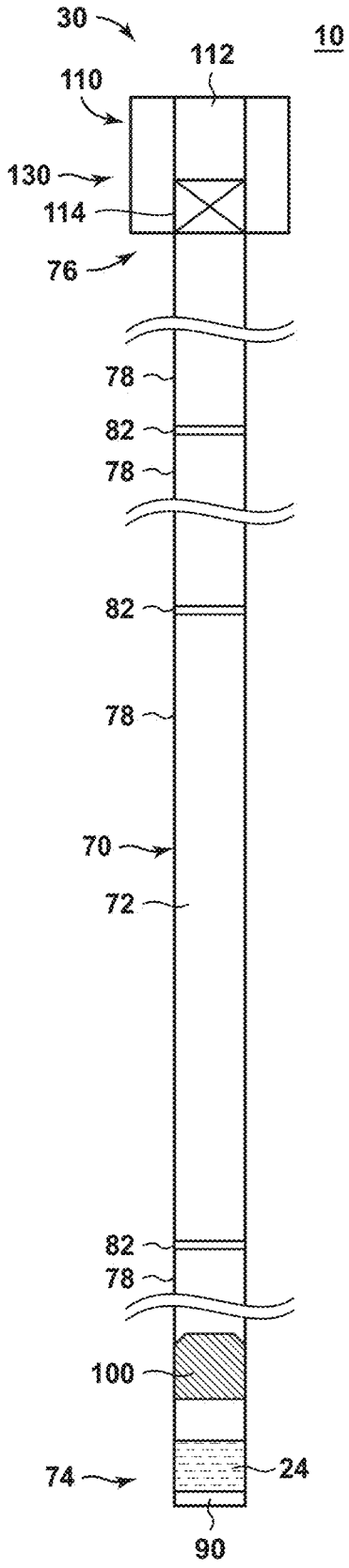
FIG. 7 is a schematic illustration of a portion of a plunger lift operation, according to the present disclosure.

As illustrated in FIG. 6, production valve 114 then may be closed, which may cease production of the produced fluid stream and/or may begin and/or initiate the shut-in time period for the hydrocarbon well. In addition, plunger 100 may be released from catcher 112. This may permit the plunger to fall, such as under the influence of gravity, toward and/or into downhole region 74 of tubing conduit 72 and/or into contact with plunger seat 90, as illustrated in FIG. 7. Motion of the plunger within tubing conduit 72 and/or toward plunger seat 90 may occur, or may be referred to herein as occurring, during a downhole travel time period of the shut-in time period. This motion may produce and/or generate acoustic output in the form of distinctive and/or corresponding sounds, which may be referred to herein as downhole travel sounds. Examples of the downhole travel sounds include joint crossing sounds, which may be generated as the plunger travels past each tubing joint 82, liquid impact sounds, which may be generated when the plunger contact, impacts, and/or impinges upon liquid 24 that may have accumulated within downhole region 74, and/or seat impact sounds, which, may be generated when the plunger contacts, impacts, and/or comes to rest upon plunger seat 90. The acoustic output during the downhole travel time period, such as the downhole travel sounds, may be detected by acoustic monitoring system 130, may be utilized to calculate, estimate, and/or quantify plunger speed of the plunger during the downhole travel time period, may be utilized to estimate a volume of liquid accumulated within the downhole region, and/or may be utilized to estimate an impact force between the plunger and the plunger seat.

Figure 8:
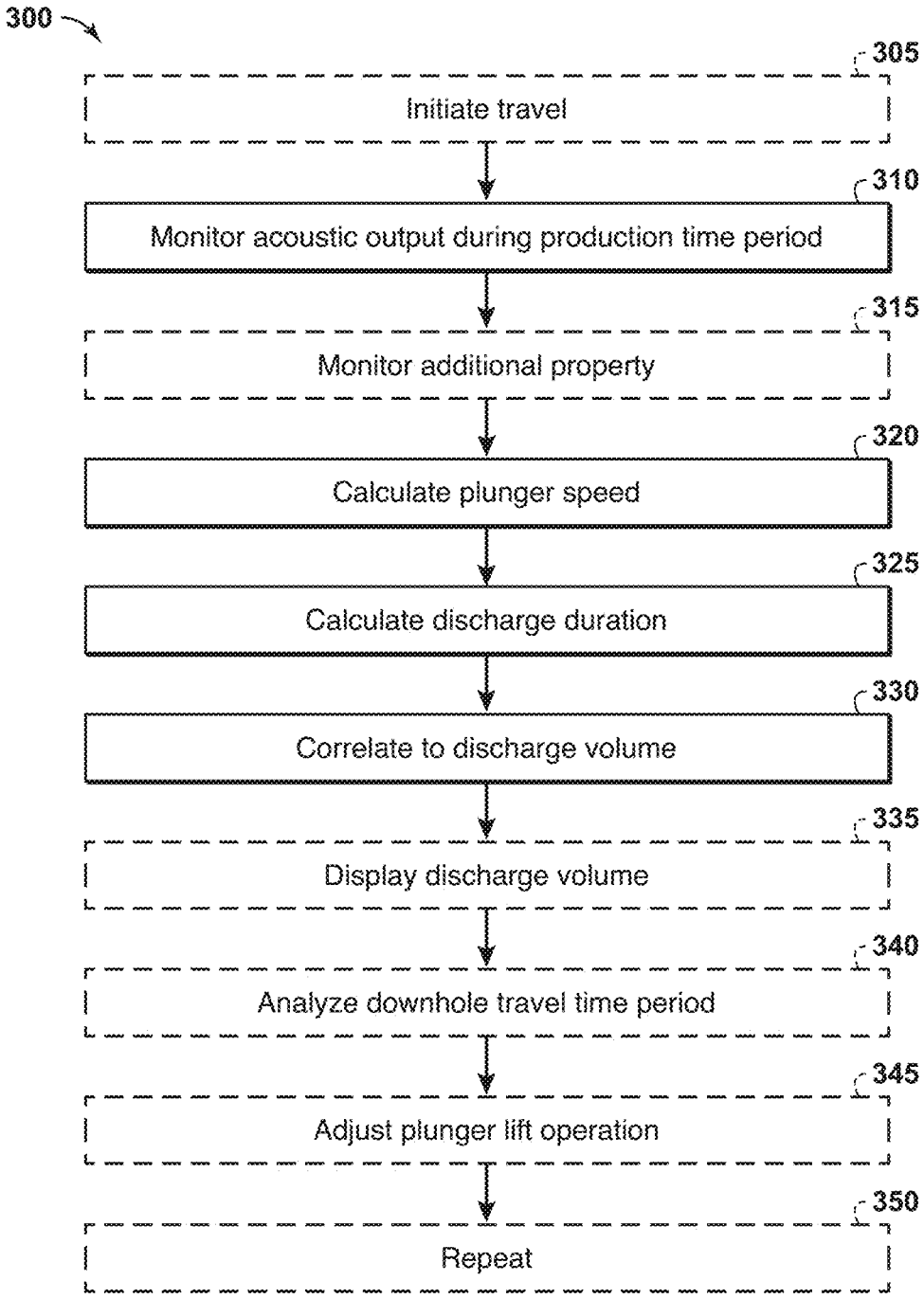
FIG. 8 is a flowchart depicting examples of methods of increasing efficiency of plunger lift operations of hydrocarbon wells, according to the present disclosure.

FIG. 8 is a flowchart depicting examples of methods 300 of increasing efficiency of plunger lift operations in hydrocarbon wells, according to the present disclosure. Methods 300 may include initiating travel at 305, and methods 300 include monitoring acoustic output during a production time period at 310. Methods 300 also may include monitoring an additional property at 315, and methods 300 include calculating a plunger speed at 320, calculating a discharge duration at 325, and correlating to a discharge volume at 330. Methods 300 further may include displaying the discharge volume at 335, analyzing a downhole travel time period at 340, adjusting the plunger lift operation at 345, and/or repeating at 350.

Initiating travel at 305 may include initiating travel of a plunger of the hydrocarbon well toward a surface region. In some examples, and prior to the initiating at 305, the plunger is positioned on and/or supported by a plunger seat of the hydrocarbon well. Examples of the plunger are disclosed herein with reference to plunger 100. Examples of the plunger seat are disclosed herein with reference to plunger seat 90.

In some examples, the initiating at 305 may include transitioning a production valve of the hydrocarbon well from a closed state to an open state, such as to permit and/or facilitate fluid flow from the hydrocarbon well. Examples of the production valve are disclosed herein with reference to production valve 114.

In some examples, the initiating at 305 may include ceasing a shut-in time period of the hydrocarbon well and/or initiating, or starting, the production time period of the hydrocarbon well. Examples of the shut-in time period and the production time period are disclosed herein.

The plunger may move, flow, and/or travel, within a tubing conduit of the hydrocarbon well and/or toward the surface region in any suitable manner and/or responsive to any suitable motive force. As an example, and as discussed in more detail herein, transitioning the production valve to the open state may permit and/or facilitate expansion of gas, which is below the plunger within the tubing conduit, to expand, thereby providing a motive force for travel of the plunger toward the surface region. In some examples, the gas may include and/or be a reservoir gas. In some such examples, methods 300 may be referred to herein as utilizing the reservoir gas to provide the motive force for travel of the plunger toward the surface region. In some examples, the gas may include and/or be an injected gas, which may be injected, or artificially injected, into the hydrocarbon well. In some such examples, methods 300 may be referred to herein as utilizing the injected gas to provide the motive force for travel of the plunger toward the surface region.

Monitoring acoustic output during the production time period at 310 may include monitoring the acoustic output from the hydrocarbon well as a function of time and/or with, via, and/or utilizing an acoustic monitoring system. Examples of the acoustic output and/or of sounds that may be included in the acoustic output are disclosed herein. Examples of the acoustic monitoring system are disclosed herein with reference to acoustic monitoring system 130.

The production time period includes an uphole travel time period during which the plunger travels toward the surface region. The production time period also includes a liquid discharge time period during which liquid, which is above the plunger during the uphole travel time period, is discharged from the hydrocarbon well. The production time period further includes a gas discharge time period during which gas, which is below the plunger during the uphole travel time period, is discharged from the hydrocarbon well. Examples of the production time period, the uphole travel time period, the liquid discharge time period, and the gas discharge time period are disclosed herein.

In some examples, the acoustic monitoring system may include a surface acoustic sensor. The surface acoustic sensor, when utilized, may be positioned in, within, and/or proximate the surface region, and the monitoring at 310 may include utilizing the surface acoustic sensor to detect, to quantify, and/or to record the acoustic output. Examples of the surface acoustic sensor are disclosed herein with reference to surface acoustic sensor 132.

In some examples, the acoustic monitoring system may include a downhole acoustic sensor. The downhole acoustic sensor, when utilized, may be positioned within and/or along a length of a wellbore of the hydrocarbon well, and the monitoring at 310 may include utilizing the surface acoustic sensor to detect, to quantify, and/or to record the acoustic output. Examples of the downhole acoustic sensor are disclosed herein with reference to downhole acoustic sensor 134.

In some such examples, the downhole acoustic sensor may include and/or be a distributed acoustic sensor. The distributed acoustic sensor, when utilized, may extend along at least a fraction, or even an entirety, of a length of the wellbore, and the monitoring at 310 may include utilizing the distributed acoustic sensor to detect, to quantify, and/or to record the acoustic output. Examples of the distributed acoustic sensor are disclosed herein with reference to distributed acoustic sensor 136.

In some examples, the acoustic output may include a plurality of sounds. In some such examples, each sound of the plurality of sounds may be generated in, within, and/or by a corresponding region of the hydrocarbon well and/or of the wellbore. In some such examples, the monitoring at 310 further may include determining a region of the distributed acoustic sensor utilized to detect each sound of the plurality of sounds. In some such examples, the monitoring at 310 further may include determining a position and/or a location, along the length of the wellbore, for each sound of the plurality of sounds. The determined location may be based, at least in part, on the region of the distributed acoustic sensor utilized to detect each sound of the plurality of sounds.

In some examples, the downhole acoustic sensor may include and/or be at least one discrete downhole acoustic sensor. The at least one discrete downhole acoustic sensor, when utilized, may be positioned at a corresponding location along the length of the wellbore. In some examples, the at least one discrete downhole acoustic sensor may include a plurality of discrete downhole acoustic sensors. In such examples, the plurality of discrete downhole acoustic sensors may be positioned at a corresponding plurality of locations along the length of the wellbore, may be positioned at a plurality of spaced-apart corresponding locations along the length of the wellbore, and/or may be spaced apart along at least a fraction of the length of the wellbore. Examples of the at least one discrete downhole acoustic sensor are disclosed herein with reference to discrete downhole acoustic sensors 138.

Monitoring the additional property at 315 may include monitoring at least one additional property of the hydrocarbon well, such as with a property sensor of the hydrocarbon well and/or during the production time period. The at least one additional property of the hydrocarbon well may be different and/or distinct from the acoustic output. Examples of the property sensor are disclosed herein with reference to property sensor 116, annulus property sensor 118, and/or production tubing property sensor 120.

When methods 300 include the monitoring at 315, the correlating at 330 further may be based, at least in part, on the at least one additional property of the hydrocarbon well. As an example, the correlating at 330 further may include verifying the plunger speed during the uphole travel time period, which is determined during the calculating at 320 and/or based upon the acoustic output. The plunger speed may be verified based, at least in part, on the at least one additional property of the hydrocarbon well. As another example, the correlating at 330 further may include verifying the discharge duration of the liquid discharge time period, which is determined during the calculating at 325 and/or based upon the acoustic output. The discharge duration may be verified based, at least in part, on the at least one additional property of the hydrocarbon well. As yet another example, the correlating at 330 further may include verifying the discharge volume of the liquid discharged from the hydrocarbon well during the discharge time period based, at least in part, on the at least one additional property of the hydrocarbon well.

As additional examples, the correlating at 330 further may include adjusting the plunger speed, the discharge duration, and/or the discharge volume based, at least in part, on the at least one additional property of the hydrocarbon well. Stated another way, the calculating at 320, the calculating at 325, and the correlating at 330 may be utilized to determine the plunger speed, the discharge duration, and the discharge volume, respectively; and a magnitude of one or more of these parameters may be adjusted based, at least in part, on the at least one additional property of the hydrocarbon well.

Examples of the at least one additional property of the hydrocarbon well and/or of parameters that may be monitored and/or quantified by the property sensor include a temperature and/or a pressure of a produced fluid stream that is produced from the hydrocarbon well. Additional examples of the at least one additional property of the hydrocarbon well include a differential pressure between the produced fluid stream and an annular space that is defined within the hydrocarbon well. Still further examples of the at least one additional property of the hydrocarbon well include a flow rate of the produced fluid stream, a flow rate of gas discharged from the hydrocarbon well within the produced fluid stream, and/or a flow rate of liquid discharged from the hydrocarbon well within the produced fluid stream. Examples of the produced fluid stream are disclosed herein with reference to produced fluid stream 32. Examples of the annular space are disclosed herein with reference to annular space 60.

In a specific example, the at least one additional property of the hydrocarbon well may include the temperature of the produced fluid stream. In some such examples, the temperature of the produced fluid stream may vary, or systematically vary, with a composition of the produced fluid stream. As an example, and when the produced fluid stream includes liquids, or primarily liquids, the liquids may have a liquid temperature. In addition, and when the produced fluid stream includes gases, or primarily gasses, the gasses may have a gas temperature. The gas temperature may differ from the liquid temperature, such as may be caused by expansion of the gasses within the tubing conduit. With this in mind, the temperature of the produced fluid stream may be utilized to supplement, or to verify, the acoustic output from the hydrocarbon well, such as to provide an alternative mechanism via which the discharge duration of the liquid discharge time period may be determined and/or calculated.

Calculating the plunger speed at 320 may include calculating the plunger speed of the plunger during the uphole travel time period. The calculating at 320 may include calculating the plunger speed based, at least in part, on the acoustic output during the uphole travel time period. As an example, the acoustic output during the uphole travel time period may include a plurality of uphole travel sounds, which may be indicative of motion of the plunger within the hydrocarbon well and/or toward the surface region. In some such examples, the calculating at 320 may include calculating the plunger speed based, at least in part, on the plurality of uphole travel sounds.

In a specific example, the hydrocarbon well may include production tubing that may form, define, and/or bound the tubing conduit. In some such examples, the production tubing may include a plurality of tubing segments joined by a plurality of tubing joints. Examples of the production tubing are disclosed herein with reference to production tubing 70. Examples of the tubing conduit are disclosed herein with reference to tubing conduit 72. Examples of the tubing segments are disclosed herein with reference to tubing segments 78. Examples of the tubing joints are disclosed herein with reference to tubing joints 82.

In some such examples, the acoustic output during the uphole travel time period may include a plurality of joint crossing sounds, which may be generated as the plunger travels past each tubing joint of the plurality of tubing joints. In some such examples, the calculating at 320 may include calculating the plunger speed based, at least in part, on the plurality of joint crossing sounds.

As a more specific example, each tubing segment of the plurality of tubing segments may have and/or define a predetermined segment length. In some such examples, the calculating at 320 may include calculating the plunger speed based, at least in part, on a segment travel time between successive joint crossing sounds of the plurality of joint crossing sounds and a corresponding predetermined segment length. More specifically, the calculating at 320 may include calculating the plunger speed based upon the corresponding predetermined segment length divided by the segment travel time.

In some such examples, the calculating at 320 may include calculating an average plunger speed. The average plunger speed may be based, at least in part, on an average segment travel time duration for the plurality of joint crossing sounds and the corresponding predetermined segment length. Examples of the average plunger speed include a mean plunger speed, a median plunger speed, and/or a mode plunger speed.

In some examples, the calculating at 320 may include assuming a constant, or at least substantially constant, plunger speed. In some examples, the calculating at 320 may include calculating a variability in the plunger speed. In some such examples, the variability in the plunger speed may be calculated based, at least in part, on a variation in the average segment travel time duration and the corresponding predetermined segment length. Examples of the variability in the plunger speed include a variance of the plunger speed, a standard deviation of the plunger speed, an error bar on the plunger speed, and/or a confidence interval for the plunger speed.

In some examples, the correlating at 330 further may include correlating the variability in the plunger speed to a variability in the discharge volume. Examples of the variability in the discharge volume include a variance of the discharge volume, a standard deviation of the discharge volume, an error bar on the discharge volume, and/or a confidence interval for the discharge volume.

Calculating the discharge duration at 325 may include calculating the discharge duration of the liquid discharge time period. The calculating at 325 may include calculating the discharge duration in any suitable manner and/or utilizing any suitable criteria. As an example, the acoustic output may include an initial liquid discharge sound, such as may be generated responsive to initiation of liquid flow in the produced fluid stream. The initial liquid discharge sound may be associated with a liquid discharge start time for the liquid discharge time period. In addition, the acoustic output may include an initial gas discharge sound, such as may be generated responsive to initiation of gas flow in the produced fluid stream. The initial gas discharge sound may be associated with a gas discharge start time for the gas discharge time period. In some such examples, the calculating at 325 may include calculating a difference between the gas discharge start time and the liquid discharge start time.

Correlating to the discharge volume at 330 may include correlating the plunger speed during the uphole travel time period and the discharge duration of the liquid discharge time period to the discharge volume of the liquid discharged from the hydrocarbon well during the liquid discharge time period. In some examples, the correlating at 330 may include calculating, estimating, determining, and/or quantitatively describing the discharge volume of the liquid. Additionally or alternatively, and in some examples, the correlating at 330 may include qualitatively and/or proportionately measuring and/or describing the discharge volume of the liquid, such as via determination of a discharge volume parameter that may be indicative of, proportional to, and/or directly proportional to the discharge volume.

In a specific example, the correlating at 330 may include calculating the discharge volume based, at least in part, on the plunger speed, the discharge duration, and a characteristic dimension for fluid flow within the hydrocarbon well. In another specific example, the correlating at 330 may include calculating a product of the plunger speed, the discharge duration, and the characteristic dimension for fluid flow within the hydrocarbon well. Examples of the characteristic dimension for fluid flow within the hydrocarbon well include a plunger outer diameter of the plunger, a conduit outer diameter of the tubing conduit, and/or a tubing inner diameter of the production tubing.

Displaying the discharge volume at 335 may include displaying the discharge volume in any suitable manner and/or for any suitable purpose. As examples, the displaying at 335 may include displaying the discharge volume with, via, and/or utilizing a display, a television, and/or a computer monitor. As another example, the displaying at 335 may include displaying the discharge volume for, or in view of, an operator of the hydrocarbon well.

In some examples of methods 300, the monitoring at 310 also may be performed during a downhole travel time period, which may be subsequent to the gas discharge time period. During the downhole travel time period, and as discussed in more detail herein, the plunger may travel away from the surface region and/or may travel into contact with the plunger seat of the hydrocarbon well. In some examples, the acoustic output further may include downhole travel sounds generated during the downhole travel time period. In some such examples, the analyzing the downhole travel time period at 340 may include analyzing the acoustic output during the downhole travel time period. This may include analyzing the acoustic output during the downhole travel time period to monitor an impact between the plunger and the plunger seat, to monitor a downhole travel speed of the plunger, and/or to monitor an impact between the plunger and any liquids that may accumulate within a downhole region of the wellbore, which may be proximate and/or may include the plunger seat.

Adjusting the plunger lift operation at 345 may include adjusting at least one property of the plunger lift operation and may be based, at least in part, on the discharge volume determined during the correlating at 330. This may include adjusting any suitable property of the plunger lift operation in any suitable manner and/or utilizing any suitable criteria. As an example, the adjusting at 345 may include increasing the shut-in time period, or a magnitude of the shut-in time period, of the hydrocarbon well. In some such examples, the increasing may be responsive to the discharge volume being less than a desired, target, or threshold discharge volume or discharge volume range. As another example, the adjusting at 345 may include decreasing the shut-in time period, or the magnitude of the shut-in time period, of the hydrocarbon well responsive to the discharge volume being greater than the desired, target, or threshold discharge volume or discharge volume range.

When methods 300 include the initiating at 305, the adjusting at 345 additionally or alternatively may include delaying the initiating at 305, such as to increase the shut-in time period, and/or expediting the initiating at 305, such as to decrease the shut-in time period. Additionally or alternatively, the adjusting at 345 may include adjusting a ratio of the shut-in time period, or the magnitude of the shut-in time period, to the production time period, or a magnitude of the production time period.

When methods 300 include the analyzing at 340, the adjusting at 345 may include increasing the gas discharge time period responsive to the acoustic output during the downhole travel time period indicating that an impact force between the plunger and the plunger seat is greater than a threshold desired impact force, or impact force range. The increasing the gas discharge time period may include permitting liquid, or additional liquid, to flow into the hydrocarbon well such that the liquid cushions the impact between the plunger and the plunger seat. Additionally or alternatively, the adjusting at 345 may include decreasing the gas discharge time period responsive to the acoustic output during the downhole travel time period indicating that the impact force is less than the threshold desired impact force, or impact force range.

Repeating at 350 may include repeating any suitable step and/or steps of methods 300 in any suitable order and/or based upon any suitable criteria. As an example, the plunger lift operation may include and/or be a cyclic plunger lift operation that includes a plurality of successive production time periods. Each production time period of the plurality of successive production time periods may include a corresponding uphole travel time period, a corresponding liquid discharge time period, and a corresponding gas discharge time period. In some such examples, the monitoring at 310 may include monitoring such that the acoustic output includes the plurality of successive production time periods, is inclusive of the plurality of successive production time periods, and/or includes sounds generated during the plurality of successive production time periods.

In these examples, the repeating at 350 may include repeating at least the calculating at 320, the calculating at 325, and the correlating at 330 for each production time period of the plurality of successive production time periods. In some examples, the repeating at 350 further may include calculating a total discharge volume during the plurality of successive production time periods and/or calculating an average discharge volume during the plurality of successive production time periods.

In some examples, the repeating at 350 further may include monitoring changes in the discharge volume between successive production time periods. In some such examples, the adjusting at 345 may include adjusting the at least one property of the plunger lift operation responsive to a change in the discharge volume between successive production time periods. In some such examples, the adjusting at 345 may be concurrent, or at least partially concurrent, with the repeating at 350 and/or may be performed during, or repeatedly during, the repeating at 350.

In some examples, methods 300 further may include correlating the acoustic output during the liquid discharge time period to a composition of the liquid discharged during the liquid discharge time period. As examples, the correlating the acoustic output to the composition of the liquid may include correlating the acoustic output to a transition from production of hydrocarbon condensate to production of water, to a water fraction of the liquid, and/or to a hydrocarbon fraction of the liquid.

In some such examples, the adjusting at 345 further may include adjusting the at least one property of the plunger lift operation responsive to a change in the composition of the liquid between successive production time periods. In such examples, the adjusting at 345 may include adding a liquid/gas separator to the hydrocarbon well responsive to the repeating at 350 indicating that greater than a threshold volume of liquid is discharged during each liquid discharge time period. Additionally or alternatively, the adjusting at 345 may include adding an oil/water separator to the hydrocarbon well responsive to the repeating at 350 indicating that greater than a threshold volume of water is discharged during each liquid discharge time period.

As yet another example, and when methods 300 include the repeating at 350, the adjusting at 345 may include incrementally changing the shut-in time period, or the magnitude of the shut-in time period, and/or incrementally changing the production time period, or the magnitude of the production time period, to improve, optimize, and/or maximize gas production from the hydrocarbon well. As an example, the repeating at 350 may include calculating and/or estimating changes in an amount of gas produced during each successive gas discharge time period and correlating the changes in the amount of gas produced to incremental changes in the shut-in time period and/or in the production time period to improve, optimize, or maximize gas production from the hydrocarbon well.

Figure 9:
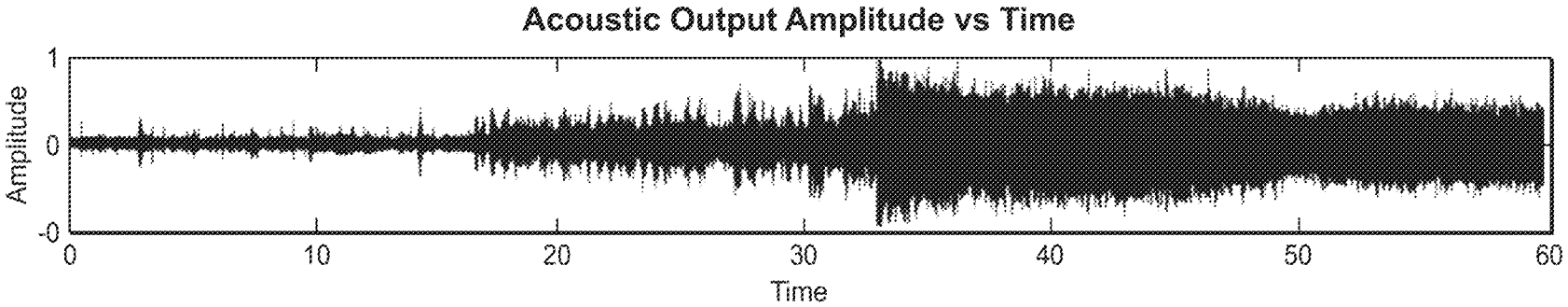
FIG. 9 is an example of acoustic output amplitude as a function of time that may be utilized with the hydrocarbon wells and methods, according to the present disclosure.

The following is a more specific but still illustrative, non-exclusive example of analyses that may be performed, during methods 300, to produce, generate, and/or facilitate the correlating at 330. In this example, an amplitude of the acoustic output as a function of time may be determined, monitored, recorded, and/or received by the acoustic monitoring system, during the production time period, and/or during the monitoring at 310. An example of the amplitude of the acoustic output as the function of time is illustrated in FIG. 9.

Figure 10:
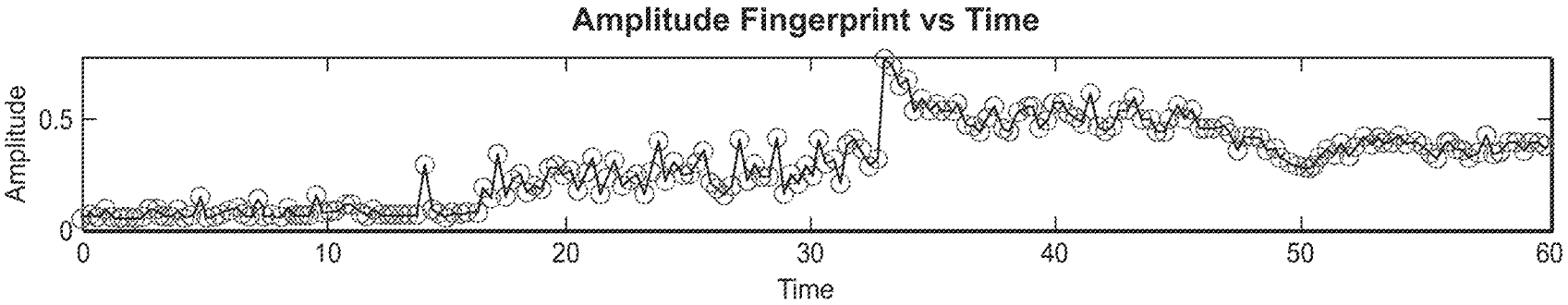
FIG. 10 is an example of an amplitude fingerprint as a function of time that may be generated from the acoustic output of FIG. 9.

Methods 300 may include downsampling the amplitude of the acoustic output as the function of time to produce and or generate an amplitude fingerprint of the acoustic output, an example of which is illustrated in FIG. 10. The amplitude fingerprint then may be analyzed, utilizing an amplitude fingerprint anomaly detection algorithm, to determine the plunger speed during the uphole travel time period. An example of the amplitude fingerprint anomaly detection algorithm includes windowed statistical analysis. Additional examples of anomaly detection algorithms, such as the amplitude fingerprint anomaly detection algorithm, are disclosed in U.S. Pat. No. 8,380,435, the complete disclosure of which is hereby incorporated by reference.

In a specific example, and as discussed in more detail herein, the hydrocarbon well may include production tubing that defines the production conduit. As also discussed, the production tubing includes the plurality of tubing segments joined by the plurality of tubing joints. The acoustic output during the uphole travel time period may include the plurality of joint crossing sounds, which may be generated as the plunger travels past each tubing joint of the plurality of tubing joints. In such an example, the calculating at 320 may include utilizing the amplitude fingerprint anomaly detection algorithm to analyze the amplitude fingerprint and to estimate times at which the plunger travels past at least a subset of the plurality of tubing joints.

Figure 11:
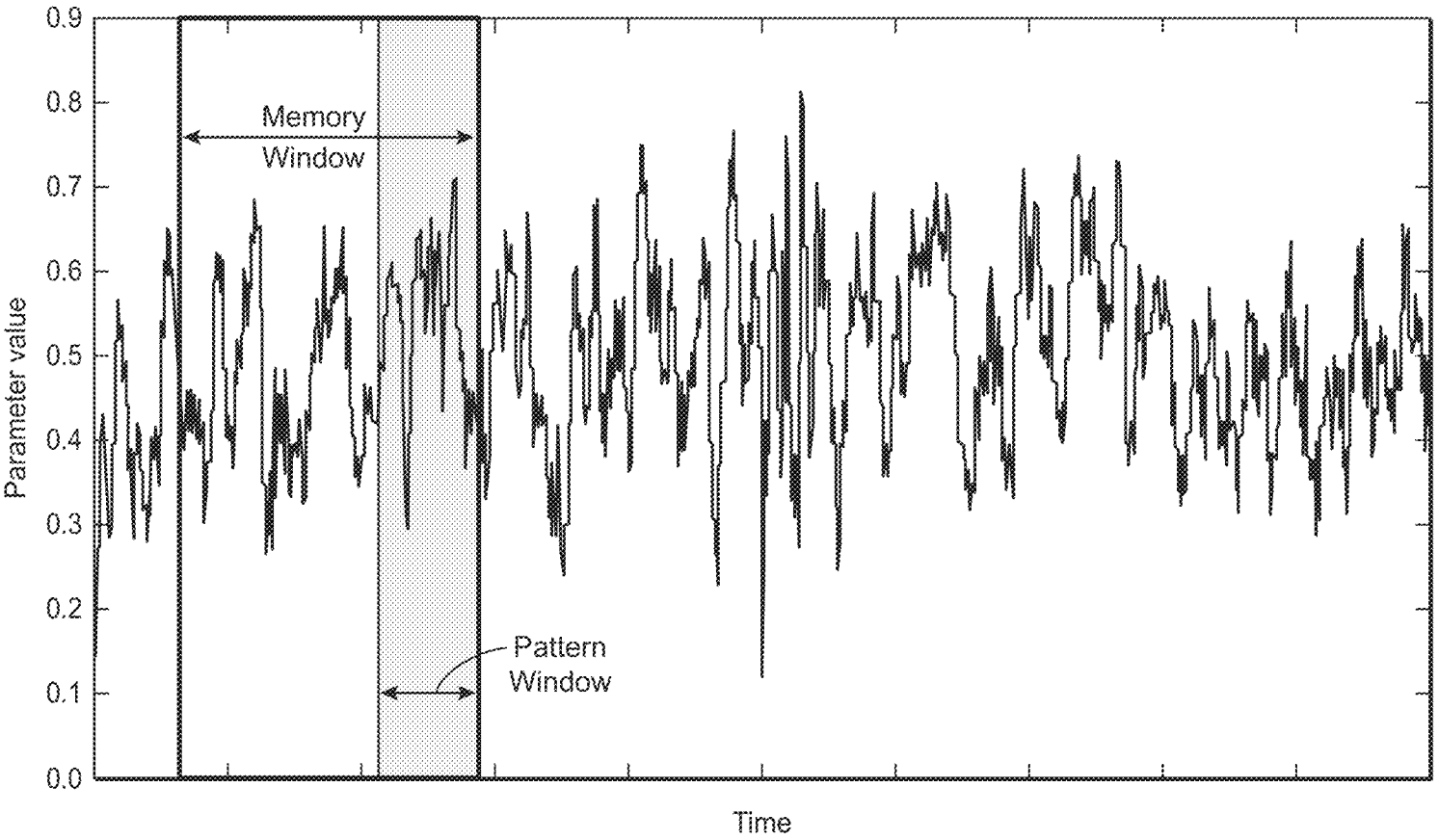
FIG. 11 is an example of an anomaly detection algorithm, in the form of a windowed statistical analysis, which may be utilized to detect anomalies in acoustic data, according to the present disclosure.
Figure 12:
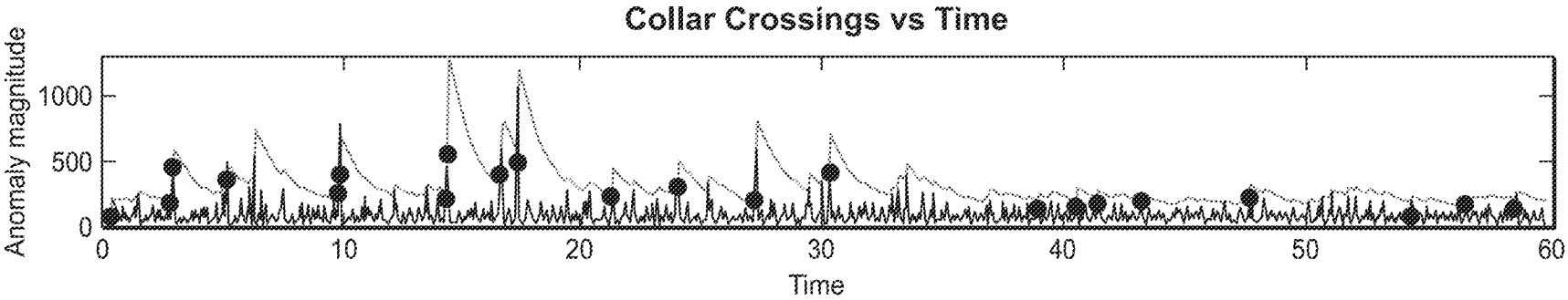
FIG. 12 is an example of detection of collar crossing sounds utilizing an anomaly detection algorithm, according to the present disclosure.

In general, anomaly detection algorithms, such as windowed statistical analysis, may compare data within a memory window, which spans a memory window time period of a time-based dataset, to data within a pattern window, which spans a pattern window time period of the time-based dataset. Examples of the memory window and the pattern window are illustrated in FIG. 11. Based upon this comparison, the anomaly detection algorithms may indicate anomalous regions of the time-based dataset. When applied to the amplitude fingerprint of the acoustic output that is illustrated in FIG. 10, the anomaly detection algorithm may be utilized to indicate times at which joint crossing sounds occur within the acoustic output. This is illustrated in FIG. 12, with the solid circles indicating times at which joint crossing sounds are estimated to occur within the acoustic output. In the above specific example, each tubing segment of the plurality of tubing segments may have and/or define the predetermined segment length. As such, the calculating at 320 may include calculating the plunger speed based, at least in part, on the segment travel time between successive joint crossing sounds, as indicated by the time interval between successive solid circles in FIG. 12, and a corresponding predetermined segment length. More specifically, the corresponding predetermined segment length divided by the segment travel time may be indicative of, or may be, the plunger speed between successive joints from which the successive joint crossing sounds were generated.

Figure 13:
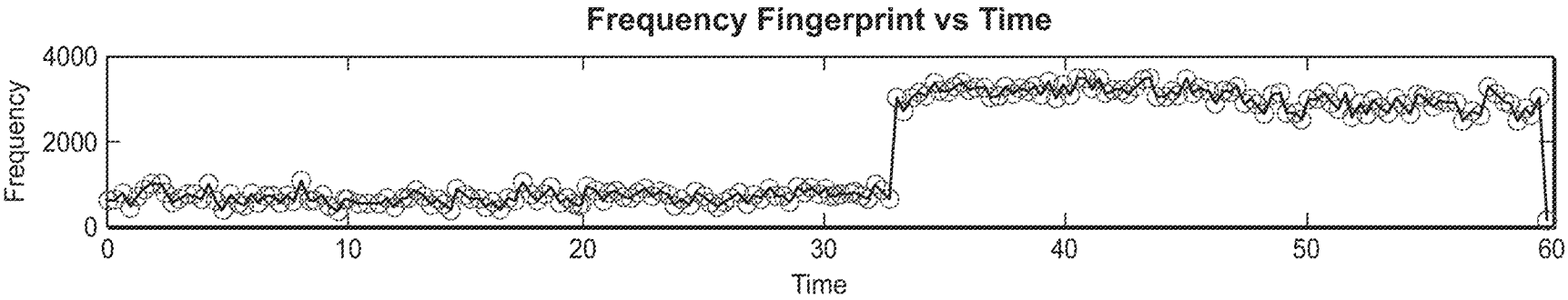
FIG. 13 is an example of a frequency fingerprint as a function of time that may be generated from the acoustic output of FIG. 9.
Figure 14:
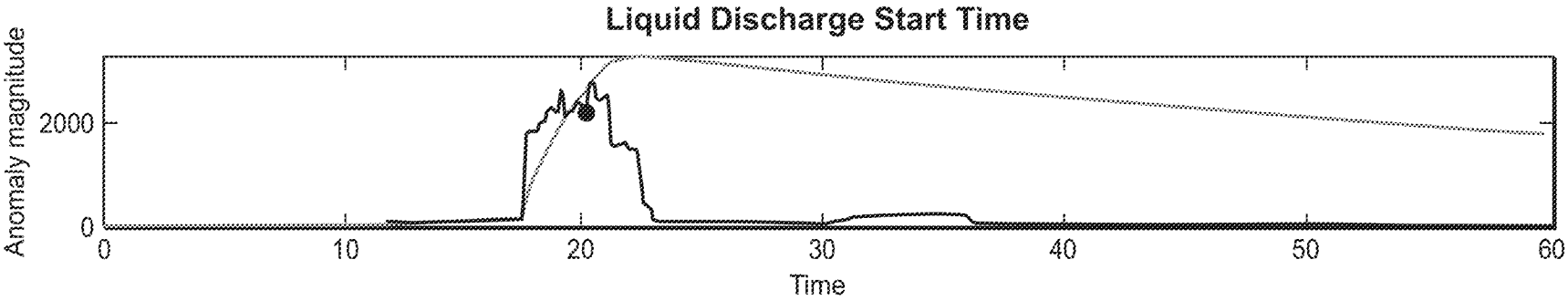
FIG. 14 is an example of estimation of a liquid discharge start time utilizing a frequency fingerprint anomaly detection algorithm, according to the present disclosure.
Figure 15:
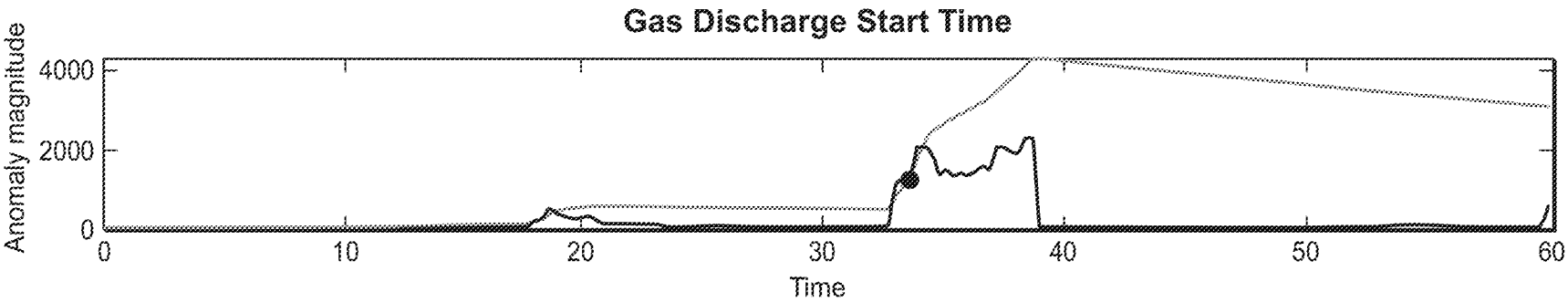
FIG. 15 is an example of estimation of a gas discharge state time utilizing a frequency fingerprint anomaly detection algorithm, according to the present disclosure.

Also in this specific example, methods 300 may include determining a frequency of the acoustic output as a function of time and downsampling the frequency of the acoustic output as the function of time to generate a frequency fingerprint of the acoustic output. An example of the frequency fingerprint of the acoustic output is illustrated in FIG. 13. In some such examples, the calculating at 325 may include analyzing the amplitude fingerprint utilizing the amplitude fingerprint anomaly detection algorithm and/or analyzing the frequency fingerprint utilizing a frequency fingerprint detecting algorithm. More specifically, and in some such examples, the frequency fingerprint anomaly detection algorithm may be utilized to analyze the frequency fingerprint to determine a time at which a frequency anomaly indicates a liquid discharge start time for liquid flow from the hydrocarbon well. This is indicated by the time associated with the solid circle in FIG. 14. In addition, the frequency fingerprint anomaly detection algorithm may be utilized to analyze the frequency fingerprint to determine a time at which a frequency anomaly indicates a gas discharge start time for gas flow from the hydrocarbon well. This is indicated by the time associated with the solid circle in FIG. 15. The liquid discharge duration then may be calculated from the difference between the gas discharge start time and the liquid discharge start time. A similar analysis additionally or alternatively may be applied utilizing the amplitude anomaly detection algorithm and the amplitude fingerprint.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of increasing efficiency of a plunger lift operation of a hydrocarbon well, the method comprising:

monitoring, with an acoustic monitoring system and during a production time period, an acoustic output from the hydrocarbon well as a function of time, wherein the production time period includes:

(i) an uphole travel time period during which a plunger of the hydrocarbon well travels toward a surface region;

(ii) a liquid discharge time period during which a liquid, which is above the plunger during the uphole travel time period, is discharged from the hydrocarbon well; and (iii) a gas discharge time period during which a gas, which is below the plunger during the uphole travel time period, is discharged from the hydrocarbon well, the gas discharge time period being identified by a change in a frequency fingerprint detected in a downsampled plot of the acoustic output;

calculating a plunger speed of the plunger during the uphole travel time period based, at least in part, on the acoustic output during the uphole travel time period;

calculating a discharge duration of the liquid discharge time period; and correlating the plunger speed during the uphole travel time period and the discharge duration to a discharge volume of the liquid discharged from the hydrocarbon well during the liquid discharge time period.

2. The method of claim 1, wherein the acoustic monitoring system includes a surface acoustic sensor positioned proximate the surface region, and further wherein the monitoring includes utilizing the surface acoustic sensor to detect the acoustic output.

3. The method of claim 2, wherein the surface acoustic sensor includes at least one of at least one surface microphone and at least one surface vibration sensor.

4. The method of claim 1, wherein the acoustic monitoring system includes a downhole acoustic sensor that is positioned along a length of a wellbore of the hydrocarbon well, and further wherein the monitoring includes utilizing the downhole acoustic sensor to detect the acoustic output.

5. The method of claim 4, wherein the downhole acoustic sensor includes a distributed acoustic sensor that extends along at least a fraction of the length of the wellbore, and further wherein the monitoring includes utilizing the distributed acoustic sensor to detect the acoustic output.

6. The method of claim 5, wherein the distributed acoustic sensor includes a fiber optic cable that extends along the fraction of the length of the wellbore.

7. The method of claim 5, wherein the acoustic output includes a plurality of sounds, and further wherein the method includes determining a region of the distributed acoustic sensor utilized to detect each sound of the plurality of sounds.

8. The method of claim 7, wherein the method further includes determining a position, along the length of the wellbore, for each sound of the plurality of sounds based, at least in part, on the region of the distributed acoustic sensor utilized to detect each sound of the plurality of sounds.

9. The method of claim 4, wherein the downhole acoustic sensor includes at least one discrete downhole acoustic sensor.

10. The method of claim 9, wherein the at least one discrete downhole acoustic sensor includes at least one of at least one downhole microphone and at least one downhole vibration sensor.

11. The method of claim 9, wherein the at least one discrete downhole acoustic sensor includes a plurality of discrete downhole acoustic sensors spaced-apart along at least a fraction of the length of the wellbore.

12. The method of claim 1, wherein the acoustic output during the uphole travel time period includes a plurality of uphole travel sounds indicative of motion of the plunger within the hydrocarbon well, and further wherein the calculating the plunger speed includes calculating the plunger speed based, at least in part, on the plurality of uphole travel sounds.

13. The method of claim 1, wherein the hydrocarbon well includes production tubing that defines a tubing conduit, wherein the production tubing includes a plurality of tubing segments joined at a plurality of tubing joints, wherein the acoustic output during the uphole travel time period includes a plurality of joint crossing sounds generated as the plunger travels past each tubing joint of the plurality of tubing joints, and further wherein the calculating the plunger speed includes calculating the plunger speed based, at least in part, on the plurality of joint crossing sounds.

14. The method of claim 13, wherein each tubing segment of the plurality of tubing segments has a predetermined segment length, and further wherein the calculating the plunger speed includes calculating based, at least in part, on a segment travel time duration between successive joint crossing sounds of the plurality of joint crossing sounds and a corresponding predetermined segment length.

15. The method of claim 14, wherein the calculating the plunger speed includes calculating an average plunger speed based, at least in part, on an average segment travel time duration and the corresponding predetermined segment length.

16. The method of claim 14, wherein the calculating the plunger speed further includes calculating a variability in the plunger speed based, at least in part, on a variation in an average segment travel time duration and the corresponding predetermined segment length.

17. The method of claim 16, wherein the correlating further includes correlating the variability in the plunger speed to a variability in the discharge volume.

18. The method of claim 1, wherein the acoustic output includes an initial liquid discharge sound, which is associated with a liquid discharge start time for the liquid discharge time period, and an initial gas discharge sound, which is associated with a gas discharge start time for the gas discharge time period, and further wherein the calculating the discharge duration includes calculating a difference between the gas discharge start time and the liquid discharge start time.

19. The method of claim 1, wherein the correlating includes at least one of:

(i) determining the discharge volume; and (ii) determining a discharge volume parameter that is indicative of the discharge volume.

20. The method of claim 1, wherein the correlating includes calculating the discharge volume based, at least in part, on the plunger speed, the discharge duration, and a characteristic dimension for fluid flow within the hydrocarbon well.

21. The method of claim 1, wherein the correlating includes calculating a product of the plunger speed, the discharge duration, and a characteristic dimension for fluid flow within the hydrocarbon well to determine the discharge volume.

22. The method of claim 20, wherein the characteristic dimension for fluid flow within the hydrocarbon well includes at least one of:

(i) a plunger outer diameter of the plunger; and (ii) a tubing inner diameter of production tubing within which the plunger travels during the monitoring.

23. The method of claim 1, wherein the method further includes displaying the discharge volume for an operator of the hydrocarbon well.

24. The method of claim 1, comprising initiating travel of the plunger toward the surface region, wherein, prior to the initiating travel, the plunger is positioned on a plunger seat of the hydrocarbon well.

25. The method of claim 1, wherein calculating the plunger speed employs windowed statistical analysis, and wherein the windowed statistical analysis compares data within a memory window that spans a memory window time period of a timebased dataset, to data within a pattern window that spans a pattern window time period of the time-based dataset.

26. The method of claim 1, wherein the liquid discharge time period is identified by a change in an amplitude fingerprint detected in a downsampled plot of the acoustic output.

* * * * *